US009114311B2

(12) United States Patent
Frambach et al.

(10) Patent No.: US 9,114,311 B2
(45) Date of Patent: Aug. 25, 2015

(54) TALENT PORTFOLIO SIMULATION

(71) Applicant: Mercer (US) Inc., New York, NY (US)

(72) Inventors: Kate M. Frambach, New York, NY (US); Susan Dunn, Portland, OR (US); Jason Jeffay, Atlanta, GA (US)

(73) Assignee: Mercer (US) Inc., New York, NY (US)

( * ) Notice: Subject to any disclaimer, the term of this patent is extended or adjusted under 35 U.S.C. 154(b) by 0 days.

(21) Appl. No.: 14/251,334

(22) Filed: Apr. 11, 2014

(65) Prior Publication Data

US 2015/0202528 A1 Jul. 23, 2015

Related U.S. Application Data

(60) Provisional application No. 61/929,618, filed on Jan. 21, 2014.

(51) Int. Cl.
*A63F 3/00* (2006.01)

(52) U.S. Cl.
CPC ..... *A63F 3/00063* (2013.01)

(58) Field of Classification Search
CPC ..... A63F 3/00063; A63F 3/0003; A63F 3/00138; A63F 3/00697; A63F 3/00075; A63F 3/04; A63F 2011/0067; A63F 9/0076
USPC ..... 273/243, 288, 289, 290, 291
See application file for complete search history.

(56) References Cited

U.S. PATENT DOCUMENTS

| | | | | | |
|---|---|---|---|---|---|
| 2,230,332 | A | * | 2/1941 | Moore | 273/289 |
| 2,486,260 | A | * | 10/1949 | Church | 434/204 |
| 3,167,313 | A | * | 1/1965 | Davenport et al. | 273/262 |
| 3,347,550 | A | * | 10/1967 | Carboni | 273/282.1 |
| 3,506,268 | A | * | 4/1970 | Stadler | 273/237 |
| 4,239,229 | A | * | 12/1980 | Crossley | 273/255 |
| 6,578,008 | B1 | | 6/2003 | Chacker | |
| 7,636,680 | B2 | | 12/2009 | Gatto | |
| 7,914,286 | B2 | | 3/2011 | Lees | |
| 7,983,945 | B2 | | 7/2011 | DiBernardino et al. | |
| 2002/0143496 | A1 | | 10/2002 | Mactas et al. | |
| 2006/0261548 | A1 | * | 11/2006 | Casanova | 273/236 |

FOREIGN PATENT DOCUMENTS

WO 0013160 3/2000

OTHER PUBLICATIONS

NoviCraft, Learning is Simple—Onsite Training, Jun. 28, 2013.
Wessex Training, Team Talk, Jun. 28, 2013.

* cited by examiner

*Primary Examiner* — Vishu Mendiratta
(74) *Attorney, Agent, or Firm* — Fish & Tsang LLP

(57) ABSTRACT

A talent management portfolio game including a board representing an organization, whereby game pieces representing members of the organization having a potential value to the organization can be managed so as to maximize the value of the organization according to its members. Value pieces representing realized potential can be attached to the game pieces based on played talent action cards, thereby realizing some of the potential of the game piece. Game pieces can be promoted within the organization or exchanged in attempts to maximize the value of the organization.

10 Claims, 11 Drawing Sheets

601h

601g

TALENT PORTFOLIO SIMULATION

This application claims priority to U.S. Provisional Application No. 61/929,618 filed Jan. 21, 2014. U.S. Provisional Application 61/929,618 and all other referenced extrinsic materials are incorporated herein by reference in their entirety.

FIELD OF THE INVENTION

The field of the invention is talent and personnel management technologies.

BACKGROUND

The background description includes information that may be useful in understanding the present invention. It is not an admission that any of the information provided herein is prior art or relevant to the presently claimed invention, or that any publication specifically or implicitly referenced is prior art.

A constant challenge for organizations is how to best utilize the talents of its members. With each individual member within an organization comes a unique set of strengths and weaknesses that can affect how the individual member performs their respective functions, thus affecting the organization as a whole. The development of an organization's members can be costly in terms of time and financial investments. Additionally, organizational development at a member level can often result in management becoming individual coaches for each member or making near-sighted or otherwise "one-off" decisions about its members. Unfortunately, this approach results in a lack of focus of the organization as a whole.

Others have put forth effort towards increasing the effectiveness of an organization's individuals. For example:

Non-patent literature publication titled "Learning Path is Simple", published Jun. 28, 2013, discusses the NoviCraft game for team-building by having participants perform team-based problem scenarios. However, this publication lacks discussion as to how any evaluation or suggestion for management of the individuals with respect to the group as a whole, including any long-term team-building as a projection of the individuals as assets.

Non-patent literature publication titled "Team Talk" by Wessex Simulations, published Jun. 28, 2013 discusses a board game directed toward team-building via teamworking, communication and group awareness. The game does not discuss a future projection or direction regarding maximizing a team as a collection of individual assets. Additionally, the game lacks the incorporation of an organization management or leadership perspective, as it appears to be directed to team-building via the team members themselves.

International patent application publication WO 00/13160 to Mellander discusses the simulation of a business process for a company, including representation of employee professional and social skills. However, Mellander lacks discussion of optimization or future development the talents of the employees with regard to a group.

U.S. Pat. No. 7,983,945 to DiBernardino, et al, issued Jul. 19, 2011, discusses evaluating an organization's human assets via an index value based on human capital productivity and return on investment. However, DiBernardino lacks discussion of the future development of the organization's human assets. Further, DiBernardino lacks any discussion of a game or simulation environment.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Thus, there is still a need for systems and methods of educating and developing an organization's management of its members in an engaging and effective manner, whereby the members of an organization can be managed as short-term and/or long-term assets to the organization.

SUMMARY OF THE INVENTION

The inventive subject matter provides apparatus, systems and methods in which a talent management portfolio game can be used by managers or other members of an organization to simulate managing the members of their organization.

The talent portfolio simulation game includes at least one game board having a plurality of game spaces representative of various positions in an organization. The game spaces can be organized according to the hierarchy of an organization, such as a tree-structured hierarchy. Thus, the game board can represent an organization or a section or subset of an organization, such as a leadership structure of an organization.

The game can also include a plurality of game pieces used to represent members of an organization. The game pieces can represent the development or value potential of the member, such as by having vertical members of various lengths. The game spaces of the game board can include spaces that can accommodate the placement of the game pieces on the game board during game play. The game spaces can also include a default starting configuration for a game piece on that space at the start of the game, whereby the default starting configuration indicates the potential of a game piece that is to be placed on the game space at the start, as well as the realized value of the game piece at the start of the game.

The talent portfolio simulation game can also include value pieces representative of a member's realized value or realized talent. The value pieces are attachable to the game pieces to represent how much of a member's potential has been realized. The value pieces can comprise ringed pieces that can be attached by placing them on the vertical member of a game piece. As gameplay progresses, value pieces can be added or removed from a game piece on the game board to represent the development or regression of the leader or member represented by the game piece.

During gameplay, the actions that players can take can be governed by talent action cards. The talent action cards can include a description of the gameplay action provided by the card, a cost to play the talent action card and a gameplay outcome that indicates one or more possible results of the gameplay action. To play the talent action card, a player can pay the cost of the gameplay action via game chips included with the talent portfolio simulation game.

Some talent action cards can include more than one possible gameplay outcome. These outcomes can be categorized according to "current" and "future" outcomes, whereby the "current" outcomes are implemented right away and the "future" outcomes can be implemented at the start of a future gameplay round. Additionally, the possible outcomes can be categorized according to a "low" outcome, a "medium" outcome, and a "high" outcome.

To determine whether the applicable outcome is "low", "medium" or "high", the game includes a spinner or die having corresponding indicators of "L", "M" and "H". In embodiments, the indicators of "L", "M" and "H" can be evenly or unevenly distributed on the spinner or die. Thus, to determine the outcome(s) of a particular talent action card, a player spins the spinner (or rolls the die) and implements the outcome of the talent action card according to the spinner (or die) result.

The talent portfolio simulation game can include leader cards that correspond to the game pieces available from a pool of game pieces during gameplay. Thus, when a player exchanges a game piece from their board for a new game piece (e.g., as a result of playing a talent action card), the player can draw a leader card which can indicate the game piece that the player is awarded to replace the surrendered game piece and the amount of value pieces that the new game piece is to contain upon introduction into the game.

In an organization, there can be events beyond the control of the members or management of the organization that can affect the composition and status of the organization's members. In the talent portfolio simulation game, these events can be introduced into gameplay via event cards. The event cards can include a description of an event and an event gameplay action that is to occur when the event card is played. Examples of event gameplay actions can include forcing all players to swap game pieces with each other, to allow players to "hire away" game pieces from other players, to swap game pieces with pieces from a pool, to pay chips to retain game pieces, etc.

At the start of a game, each player can receive a game board. For each game board, a player can receive game pieces and value pieces according to the starting conditions of the board indicated by the game spaces. Each player can get a set of talent action cards for the first round and a set of chips.

The gameplay can include a number of rounds whereby talent action cards can be played within each round. The gameplay actions for the talent cards can be implemented within the round and, as applicable, at the start of future rounds. Each round can end when the players no longer have enough chips to play any additional talent action cards, when all players have played all of the talent action cards they wish to play for the round, and/or when the time allotted for a round has expired.

After a round has ended and prior to the start of a new round, one or more event cards can be played, the gameplay actions of the event card(s) carried out, and each player's game board updated to account for the gameplay actions of the event cards. In embodiments, the event cards can additionally or alternatively be played during gameplay rounds. The event cards can be drawn in between rounds by the players participating in the game. Alternatively, the event cards can be managed by a game master or moderator, which can draw the cards at random or can selectively play the event cards.

At the start of a new gameplay round, any "future" outcomes from talent action cards played in previous rounds are implemented for applicable game pieces on game boards. Following that, the potential and realized value of each game space on the game board can be updated, such as on a score box on each game space. Similarly, totals of potential and realized value for the entirety of the game board can be updated, such on a score box of the game board.

In an organization, roles and positions can have varying degrees of criticality, even within seemingly equal titles or hierarchy levels. This criticality can be reflected via multipliers on each game space corresponding to the criticality of the position within the organization. The multiplier of each game space can serve to increase the scoring associated with the game piece on the game space by providing an augment factor to the potential and realized values of the game piece. In embodiments, the game spaces on the game board can be color-coated to reflect the relative criticality or importance of the position within the organization. In these embodiments, the color scheme can be reflective of the multiplier value (e.g., a first color or color shade for all game spaces with a first multiplier value, a second color or color shade for all game spaces with a second multiplier value, and so on).

At the end of the game, a winner can be determined based on the state of each player's game board at the time the game ended. The winner can be determined based on a combination of the total potential value and total realized value for all game pieces on each player's board. In embodiments, additional winning conditions must be met to declare a winner.

Various objects, features, aspects and advantages of the inventive subject matter will become more apparent from the following detailed description of preferred embodiments, along with the accompanying drawing figures in which like numerals represent like components.

DETAILED DESCRIPTION

It should be noted that any language directed to a computer should be read to include any suitable combination of computing devices, including servers, interfaces, systems, databases, agents, peers, engines, controllers, or other types of computing devices operating individually or collectively. One should appreciate the computing devices comprise a processor configured to execute software instructions stored on a tangible, non-transitory computer readable storage medium (e.g., hard drive, solid state drive, RAM, flash, ROM, etc.). The software instructions preferably configure the computing device to provide the roles, responsibilities, or other functionality as discussed below with respect to the disclosed apparatus. In especially preferred embodiments, the various servers, systems, databases, or interfaces exchange data using standardized protocols or algorithms, possibly based on HTTP, HTTPS, AES, public-private key exchanges, web service APIs, known financial transaction protocols, or other electronic information exchanging methods. Data exchanges preferably are conducted over a packet-switched network, the Internet, LAN, WAN, VPN, or other type of packet switched network.

One should appreciate that the disclosed techniques provide many advantageous effects, including encouraging the improvement and development of an organization's talent management in both the short- and long-term via an engaging interactive environment.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 1:
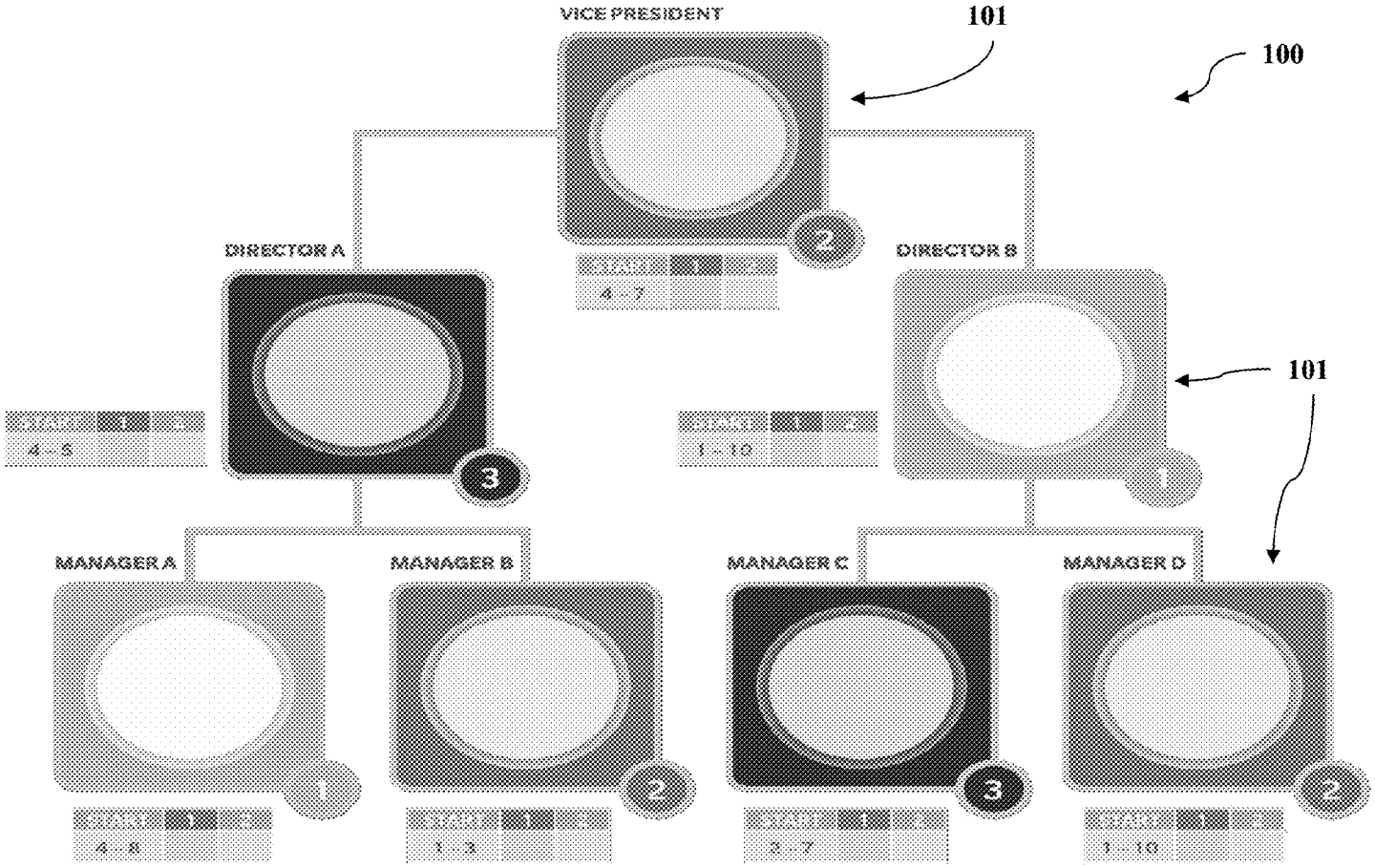
FIG. 1 provides an overview of the talent portfolio simulation game board.

FIG. 1 is an illustrative example of a game board 100 according to embodiments of the inventive subject matter.

As shown in FIG. 1, the game board 100 includes a plurality of game spaces 101 arranged according to the leadership structure of an organization. The example board 100 of FIG. 1 shows the game spaces 101 arranged in a hierarchical tree structure. However, in embodiments, the arrangement of the game spaces 101 on the game board 100 can be configured to reflect any type of organizational structure. As shown in FIG. 1, the game board 100 includes seven game spaces 101. In embodiments, the game board 100 can have a greater or lesser amount of game spaces 101, whereby the number of game spaces 101 can be selected to reflect the size of an organization, a subset (e.g., department, office within the organization, a leadership structure within a larger organization, etc.) of the organization being represented, and a level of granularity within the organization being represented.

In embodiments, the game board 100 can include a score box whereby the organizational score for the entirety of the particular game board 100 can be totaled and entered for each round. In embodiments, this score box can comprise material that allows for the entry of erasable values (e.g., via chalk, dry-erase marker, etc.). In other embodiments, the score box can be provided via a plurality of paper sheets that can be torn off and discarded after use, or via a separate notebook or other collection of paper sheets.

Figure 2:
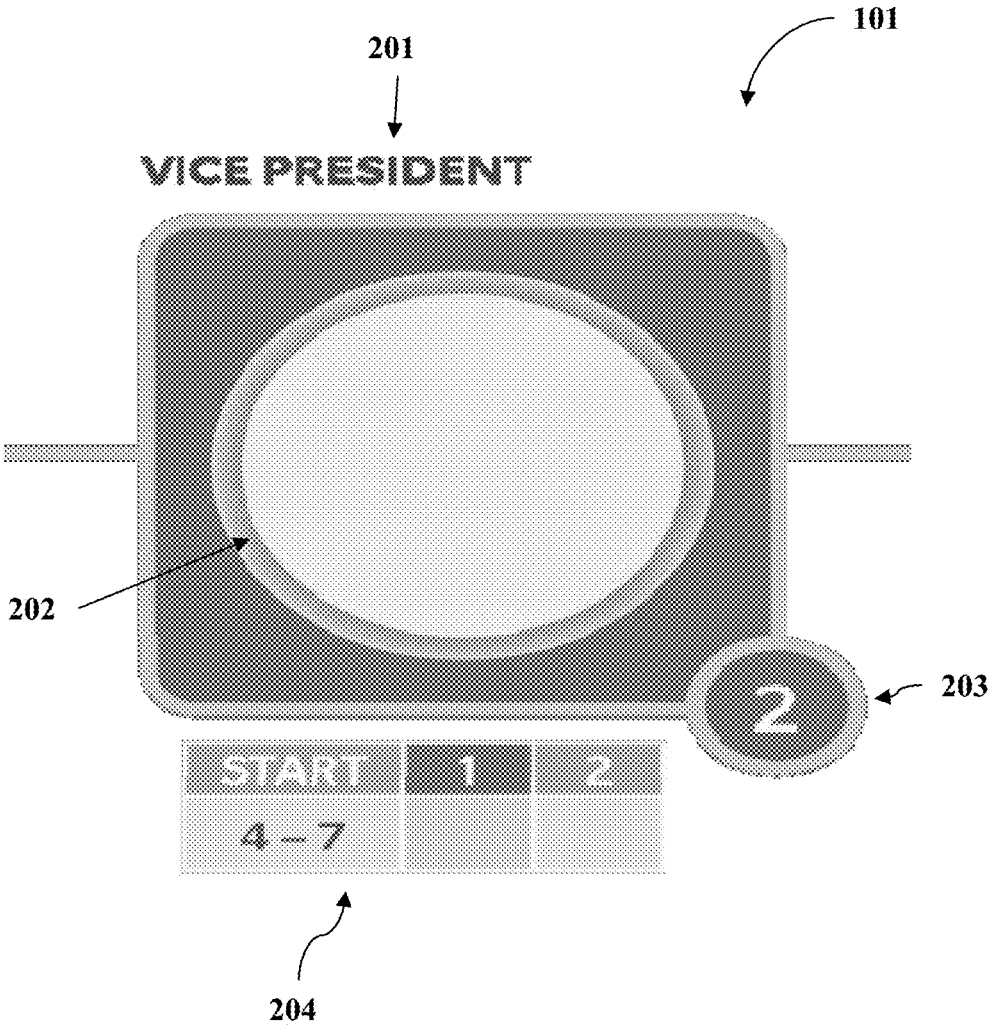
FIG. 2 provides a detailed view of a game space within the game board.

FIG. 2 provides a detailed view of an example game space 101. Game space 101 can include a title, name or other identifier 201 (e.g., "Vice President" as shown in the illustrative example) of the position within the organization.

Game space 101 can also include a game piece placement space 202, whereby game pieces are placed during gameplay. In embodiments, the game piece space 202 can match the dimensions of one or more of the game pieces' bases. In embodiments, the game piece space 202 can be printed onto the game board 100. In embodiments, the game piece space 202 can be of a different level than the surface of the game board 100 surrounding it. For example, the game piece space 202 can be recessed into the game board 100 such that the base of a game piece can be held in place within the recessed game piece space 202. In another example, the game piece space 202 can project upwardly from the game board 100 such that a corresponding recess on the underside of the game piece base fits around the projected game piece space 202.

In FIG. 2, the game piece space 202 is shown as having a round shape. However, the game piece space 202 can have other shapes. In embodiments, the shape of the game piece space 202 can be determined by a particular position represented by the game space 101 or a level in a hierarchy structure to which game space 101 belongs.

The game space 101 can also include a multiplier 203. The multiplier 203 is representative of the importance of the particular job or position within the organization. Thus, the multiplier can be a value that is used as a multiplication factor for the potential and the realized value of the game piece played on the game space 101 to determine scoring for the position within the organization. In the example illustrated in FIG. 1, the multiplier 203 can be an integer of "1", "2" or "3". It is contemplated, however, that the multiplier can include numbers larger than 3, depending on the criticality of a particular position, the amount of game spaces 101 on a particular board, etc.

In embodiments, certain game spaces 101 that represent positions that are deemed "critical" within the organization can be assigned the highest multiplier 203 values in the game. These critical game spaces 101 can also be indicated by a particular color or shade of color to emphasize their importance. In the example illustrated in FIG. 1, the game spaces 101 representing "Director A" and "Manager C" are critical, as noted by their multiplier 203 values of "3" and their dark shading relative to the other game spaces.

In embodiments, game spaces 101 can include a scoring box 204. The scoring box 204 can include an indication of the game piece that is to be placed in the game space 101 at the start of the game via an indication of the game piece's potential (i.e., the indicia on the game piece), as well as the number of value pieces attached to the game piece at the start of the game. In FIG. 2, the scoring box 204 shows that at the start of the game, the game piece on the illustrated game space 101 should be one having a potential of "7" and should have four value pieces attached (i.e., the "4-7" indication). The scoring box 204 can also include additional entries for the number of rounds to be played in the game, such that the potential capacity of a piece (e.g. due to replacing the game piece with a new piece) and/or the amount of value pieces attached to the game piece can be entered for each round. In the example of FIG. 2, the scoring box 204 includes entries for two rounds of play. In embodiments, the scoring box 204 can comprise material that allows for the entry of erasable values (e.g., via chalk, dry-erase marker, etc.). In embodiments, the scoring box 204 can be provided with the game board 100 via a separate note pad, allowing for the discard of used scoring boxes.

Figure 3:
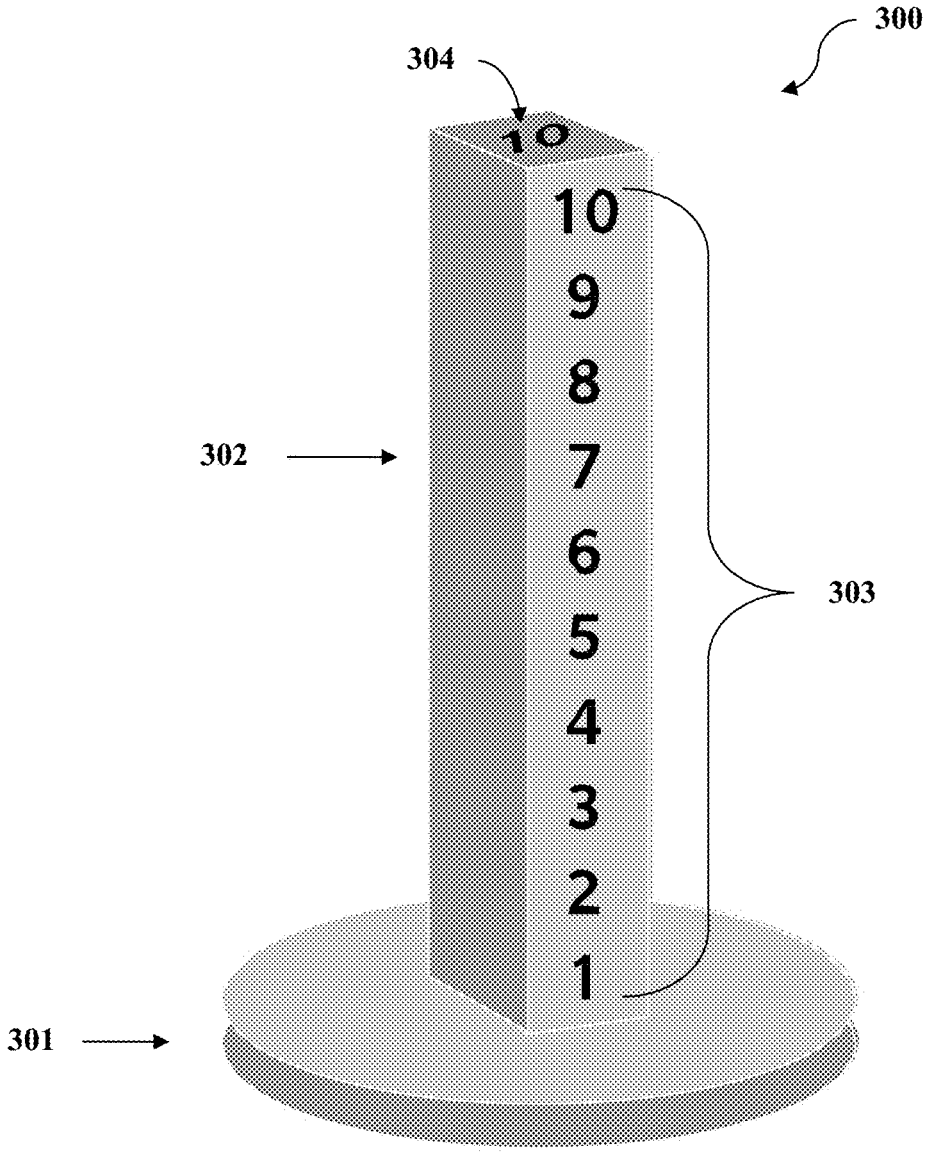
FIG. 3 provides an example of a game piece.

FIG. 3 shows an example of a game piece 300, according embodiments of the inventive subject matter. As shown in FIG. 3, the game piece 300 includes a base 301 and a vertical member 302 attached to base 301.

The vertical member 302 can include indicia 303, such as numerical indicia. The indicia 303 can be of a numerical or other sequential order, starting from the lower end of vertical member 302 and ascending to the upper end of vertical member 302. The indicia 303 indicates the potential of the individual represented by game piece 300 as the capacity of value pieces that can be attached to the game piece 300 during gameplay.

The value represented by the length of the vertical member 302 can be considered to be a long-term or potential value of an individual of the organization. In other words, the untapped or as-of-yet unrealized full potential of the individual. These potential values can be reflective of an individual's overall potential talent, an individual's total potential productivity, an individual's potential professional and/or personal growth or development, an individual's potential monetary value to an organization (e.g., sales, a measure of individual's contributions against the individual's cost to the organization, etc.), or other potential quantified characteristic being modeled.

As used herein, the game piece 300 can be considered to represent a member, individual, or leader of an organization. As such, the terms "member", "individual" and "leader" can be considered to be interchangeable unless specifically noted otherwise.

In preferred embodiments, the length of vertical member 302 is dictated by the indicia 303, whereby the length of the vertical member 302 is such that the length fits the largest number or other entry in the indicia's sequence without "empty" space sufficient to fit attachable value pieces beyond the amount indicated by the indicia 303. In FIG. 3, the example game piece 300 is shown as having a potential of "10", with the vertical member 302 of a sufficient length to fit the indicia sequence of "1" through "10". However, it is contemplated that the talent simulation game include game pieces 300 having varying potential amounts. Thus, the length of the vertical member 302 for those game pieces 300 will be of varying lengths to accommodate the indicia corresponding to their respective potential amounts.

In embodiments, game piece 300 can include identifying information for the game piece. For example, each game piece 300 within a game can have a name printed on the base such that the game pieces can be easily identified and tracked during gameplay.

In embodiments, game piece 300 can include an indicator of the total potential 304 of the game piece on the top surface of the vertical member 302. In these embodiments, the indicator 304 can be included in addition to the indicia 303. Alternatively, the indicator 304 can be included on a game piece 300 instead of the indicia 303.

Figure 4:
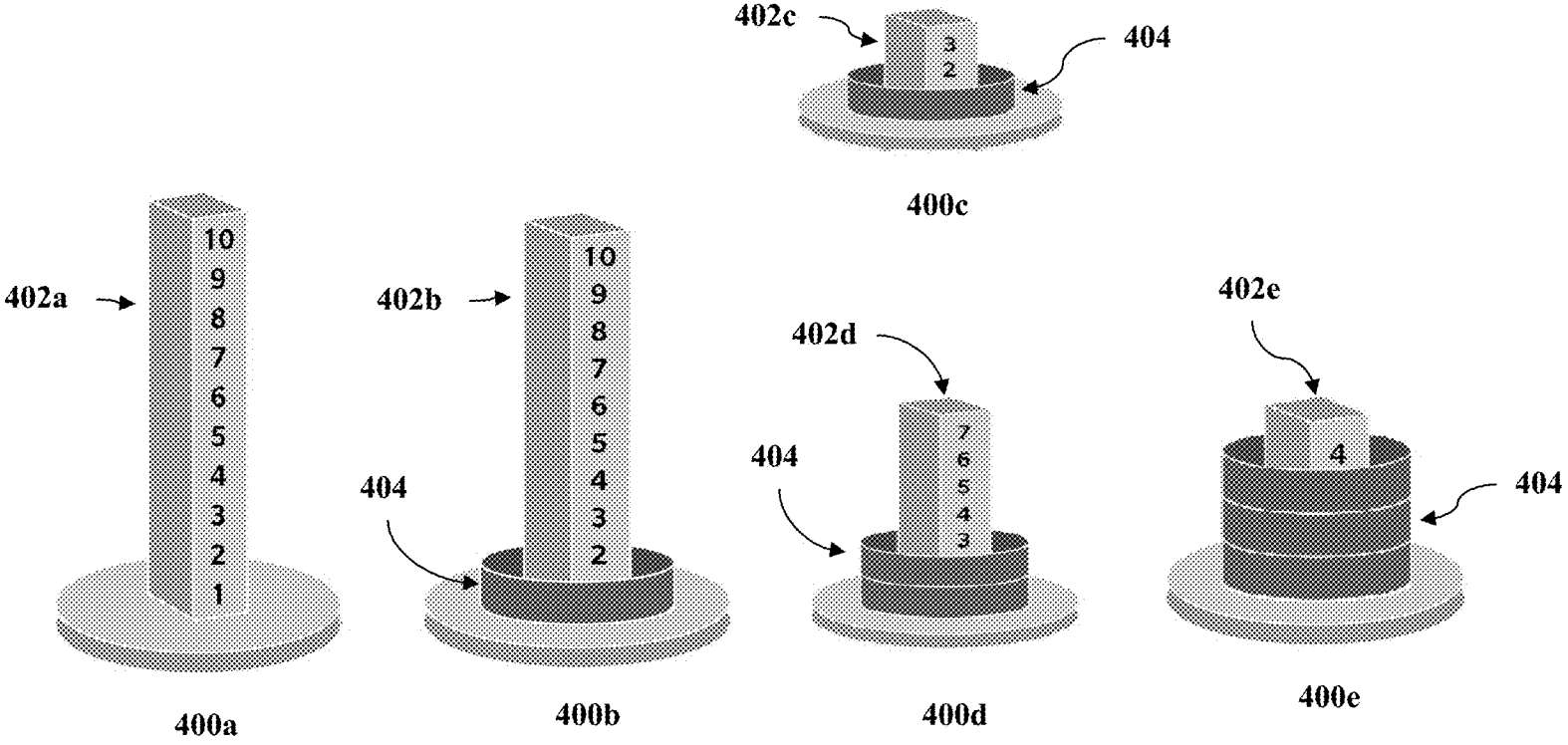
FIG. 4 provides additional examples of various game pieces and the attachment of value pieces thereto.

FIG. 4 provides examples of game piece 300, wherein game pieces 400*a*-400*e* have corresponding vertical members 402*a*-402*e* (collectively referred to as game pieces 400) of various lengths. As shown in FIG. 4, game pieces 400*a* and 400*b* both have a potential of "10" (like the game piece 300 shown in FIG. 3), game piece 400*c* has a potential of "3", game piece 400*d* has a potential of "7" and game piece 400*e* has a potential of "4". In the illustrated example, it is contemplated that the talent portfolio simulation game can include one or more game pieces having potentials of anywhere between "1" and "10".

FIG. 4 also provides an illustrated example of value pieces 404 attached to game pieces 400*b*-400*e*. The value pieces 404 are used in gameplay to represent a unit of value, to an organization, of an individual represented by a game piece 400. The value pieces 404 are shown as rings that can be attached to the game pieces 400 via placement around the game pieces' vertical member 402. In this example, the first value piece 404 can be placed around the vertical member 402 such that it rests on the base of the game piece 400. As shown by game pieces 400*d* and 400*e* subsequent value pieces 404 are placed such that they stack on the value pieces already placed on the game piece. In the example illustrated in FIG. 4, all of the value pieces 404 are intended to be identical.

In the description of the value pieces 404 herein, the value represented is a realized or short-term value (i.e., the present value of the individual to the organization). The value represented by value pieces 404 can be reflective of an individual's realized talent, an individual's productivity, an individual's professional and/or personal growth or development, an individual's monetary value to an organization (e.g., sales, a measure of individual's contributions against the individual's cost to the organization, etc.), or other quantified characteristic being modeled. In other words, accumulated value pieces 404 on a given game piece 400 can be representative of the amount short term payouts or other short term realized value of the individual whereas the length of the vertical member 402 (i.e., the total number of value pieces 404 that can be attached to the game piece 400, as indicated by the indicia on the vertical member 402) of the game piece 400 can be considered to represent the long-term growth potential of the individual.

The lengths of the vertical members 402 and value pieces 401 are configured such that each game piece 400 is only capable of holding the amount of value pieces 404 indicated by the game piece's indicia. For example, for the game pieces shown in FIG. 4, game pieces 400*a* and 400*b* can fit a total of ten value pieces, game piece 400*c* can hold a total of three value pieces, game piece 400*d* can fit a total of seven value pieces and game piece 400*e* can hold a total of four game pieces.

In embodiments, the talent portfolio simulation game can include a deck of talent action cards, a set of chips, and a random outcome generator (e.g., a die and/or a spinner).

Figure 5:
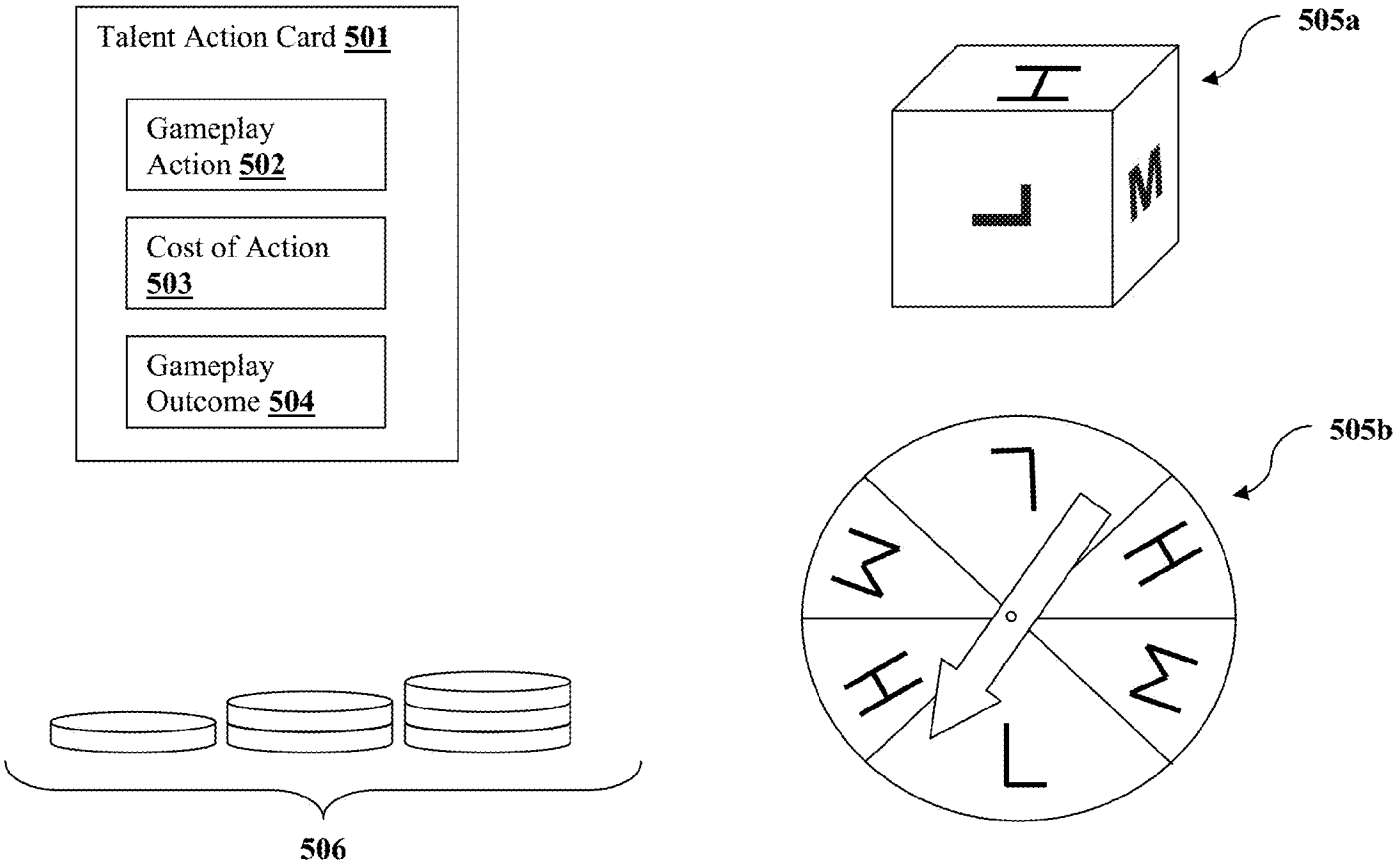
FIG. 5 provides illustrative examples of a talent action card, a die, a spinner, and game chips, according to embodiments of the inventive subject matter.

FIG. 5 provides an illustrative example of a talent action card 501. Each talent action card 501 can include a gameplay action 502 that can be performed by a player, a cost of the gameplay action 503, and a gameplay outcome 504 indicating one or more possible outcomes from executing the gameplay action 502. The talent action cards can be categorized according to coaching cards, developing cards, rotating cards, and replacing cards, according to the actions they represent and based on the outcome of the actions.

Figure 6A:
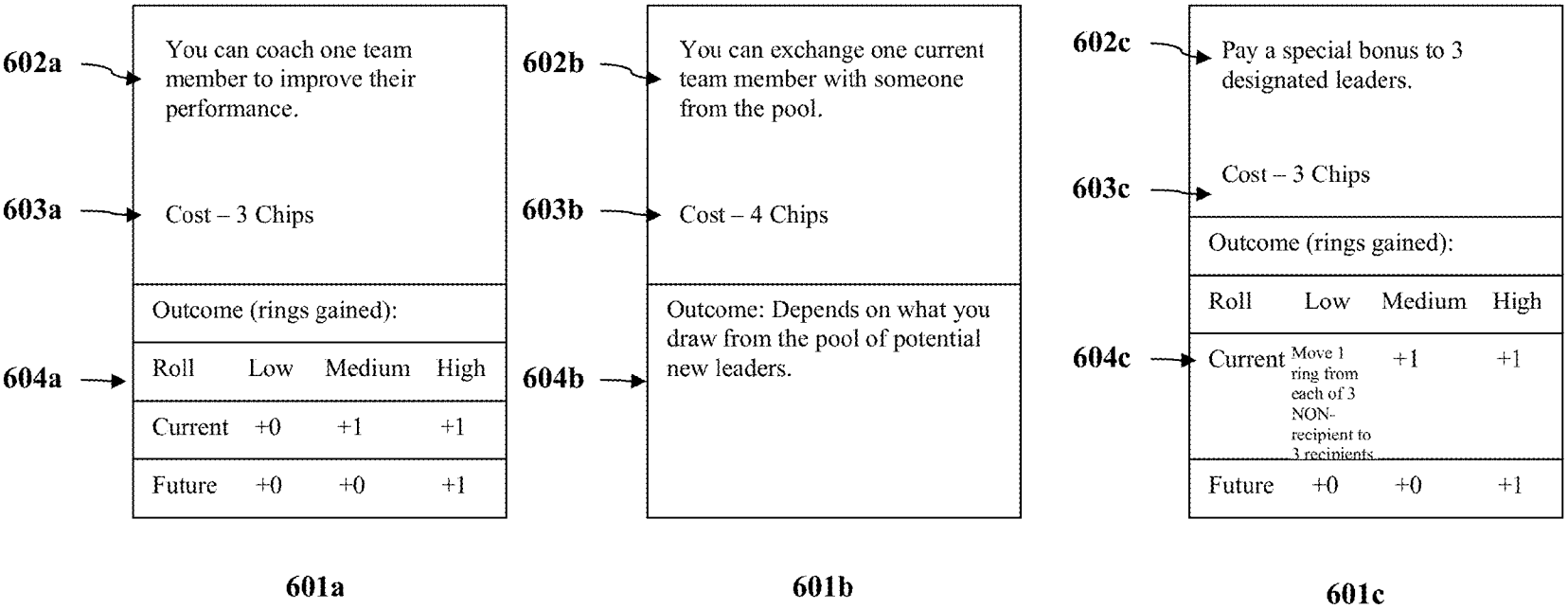
FIGS. 6A-6C provide additional examples of various talent action cards.
Figure 6B:
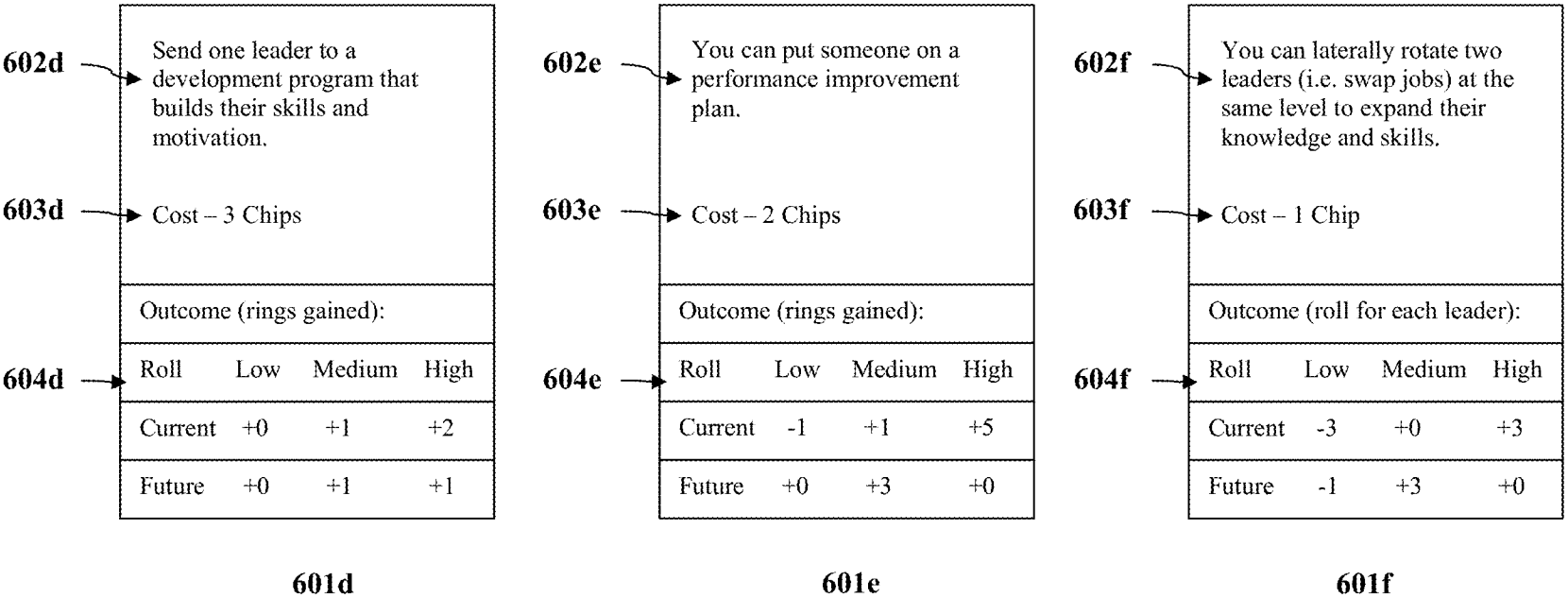
Figure 6C:
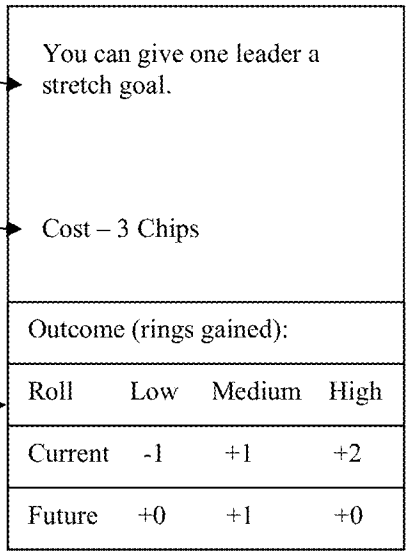
Figure 6C:
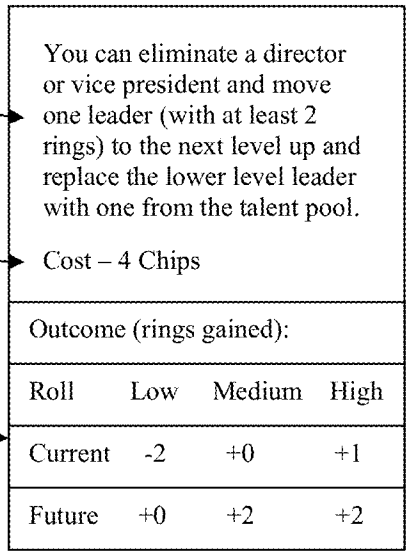

FIG. 6A-6C provides examples of talent action cards 601*a*-601*h*, illustrating various types of talent action card 501 used during gameplay.

As with card 501, each of the talent action cards 601*a*-601*h* includes a corresponding gameplay action 602*a*-602*h*, cost of the gameplay action 603*a*-603*h*, and gameplay outcome 604*a*-604*h*.

FIG. 5 also shows examples of random outcome generators 505*a* and 505*b*, according to embodiments of the inventive subject matter. As shown in FIG. 5, the random outcome generator can comprise a die 505*a*, having markings "L", "H" and "M", corresponding to rolls of "low", "medium" and "high", respectively. The die 505*a* as shown has two of each marking across its six faces. In embodiments, the distribution of the markings can be unequal across the faces of the die. For example, the die may have three "L" markings, two "M" markings and one "H" marking, increasing the odds that a roll of the die 505*a* will result in an "L".

In embodiments, the random outcome generator of the talent simulation portfolio game can include spinner 505*b* instead of die 505*a*. As shown in FIG. 5, spinner 505*b* can include spaces having markings "L", "H" and "M", corresponding to results of "low", "medium" and "high", respectively. During gameplay, players can spin spinner 505*b* such that the arrow of the spinner will stop on a portion of the spinner having an "L", "H" or "M" marking. The spinner 505*b* illustrated in FIG. 5 includes six portions, such that each marking has two portions each. In embodiments, the spinner 505*b* can include three portions (one for each marking) or be divided into other portion numbers such that each marking has an equal number of portions. In other embodiments, the spinner 505*b* can include a number of portions such that the number of portions for one or more of the markings are unequal, thus changing the probability that a spin will land on a particular marking. The example spinner 505*b* of FIG. 5 shows that the "L" sections are slightly larger than the "H" and "M" sections, such that it is slightly more likely that the arrow will stop on an "L" section than an "H" section or than an "M" section. In other embodiments, the sections can be of equal size such that each marking has an equal chance of returning in a given spin. In other embodiments, the size of the sections can be arranged such that the "H" markings and/or "M" have greater or lesser probabilities of resulting from a spin than the other markings.

Talent action cards 601*a* and 601*c*-601*h* of FIG. 6 are examples of talent action cards whose corresponding gameplay outcomes 604 are dependent on a roll of a die 505*a* or spin of a spinner 505*b*. In the illustrated examples, the result of the die roll or spinner spin can be a gain or a loss of value pieces 404 on a selected game piece 400. For gameplay outcomes 604 requiring a roll or spin, the outcomes can include a "current" outcome and a "future" outcome. For a given roll during gameplay, the "current" outcome represents an outcome that is performed immediately after the roll. For example, if a player playing card 601*a* rolls (or spins) an "H", the "current" outcome results in the player adding a value piece 404 on a game piece 400 immediately after the roll or spin (e.g., during the same round of play). Likewise, the "future" outcome represents an outcome that is performed at the start of the next round (or, in embodiments, a subsequent future round). Thus in the example of the player's roll resulting in an "H" for card 601*a*, the player would add two value piece 404 to the game piece 400 at the start of the next gameplay round. Interestingly, if the particular game piece 400 that is to receive a "future" outcome is lost prior to the next gameplay round (e.g., such as by a replacement action via playing an action card 601 or via gameplay events occurring between gameplay rounds), then the "future" outcome is rendered moot and is not carried out.

In embodiments, the gameplay outcome 604 includes both the "current" and "future" outcomes. In other words, during gameplay, both the "current" and "future" outcomes are implemented in response to a spin or roll (to the extent that the "future" outcome remains in play, as described above). In other embodiments, the player may be given the choice to elect whether to play for the "current" outcome or the "future" outcome prior to a roll or spin.

FIG. 5 provides an illustrative example of chips 506 used in the talent portfolio simulation game. In embodiments, the chips 506 in the talent portfolio simulation game can all be identical, and represent an identical amount of in-game currency. In embodiments, the chips 506 can represent various amounts of in-game currency (e.g., chips for 1 in-game unit of currency, chips for 5 in-game units of currency, etc.) and be marked with indicia indicating their in-game values. In embodiments, the chips can be designed such that they resemble real-world currency, can be marked with a company logo or name, or have other such designs. During gameplay, chips 506 can be gained and/or lost by a player and can be used for gameplay actions such as paying for a gameplay action 502 of a talent action card 501. Thus, the cost 503 of the gameplay action 502 represents the cost in chips 506.

Figure 7:
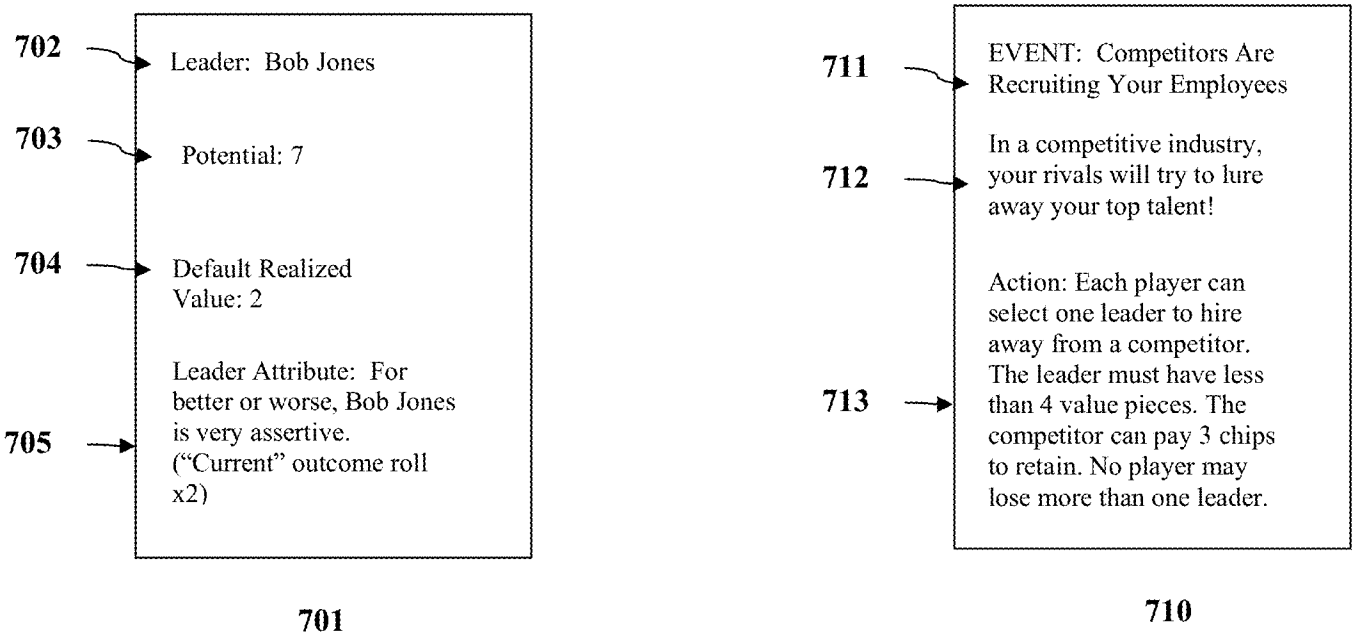
FIG. 7 provides illustrative examples of a leader card and an event card.

In embodiments, the game can include leader cards 701 corresponding to game pieces 400 in the talent portfolio simulation game, as shown in FIG. 7. In embodiments, leader cards 701 can include an identifier 702 of the game piece 400 corresponding to the card 701. In embodiments, the identifier can be of a particular game piece type (e.g., of a particular potential amount for grouped pieces, a particular hierarchy level, etc.). Leader card 701 can also include an indication of the potential 703 of the corresponding game piece 400 (e.g., the number indicated by the indicia on the vertical member of the game piece) represented by the leader card. For example, a leader card 701 having a potential of "10" corresponds to a game piece having a vertical member 402 with a highest indicia value of ten (such as game piece 400*a* of FIG. 4). In embodiments where the game pieces 400 do not include identifiers, leader cards 701 will similarly not include identifiers. In these embodiments, the leader cards 701 can then be considered to represent any game piece 400 having the potential 703 indicated by the leader card.

In embodiments, the leader cards can also include an indication 704 of a default number of value pieces 404 that the game piece 400 will have attached upon the initial use of the game piece in the game.

Thus, the illustrative example leader card 701 of FIG. 7 corresponds to the "Bob Jones" game piece 400, which has a potential 703 of "7" and a default starting realized value 704 of "2", meaning that when introduced into the game, the game piece 400 will have two value pieces 404 attached. In embodiments where the identifier 702 is not included on leader card 701, the illustrated leader card 701 can correspond to any game piece 400 having a potential of "7" and will have a realized starting value of "2". Game piece 400*d* of FIG. 4 provides an illustration of such a game piece with two default starting value pieces 404.

In embodiments, the leader card 701 can include a leader attribute 705 corresponding to a gameplay modifier or action that can occur while the game piece 400 corresponding to the leader card 701 is in play. These leader attributes can be representative of qualities or characteristics of a leader or individual that can affect their performance in a position, their growth, their progress within an organization and, ultimately, the performance of the organization as a whole. In the example of FIG. 7, the leader attribute 705 serves to multiply the "current" outcome 604 of a talent action card roll played for the "Bob Jones" game piece 400 by a factor of two. This can result in twice as many value pieces 404 gained from a talent action card 601. However, as sometimes the outcomes 604 can have negative consequences, it also can result in twice as many value pieces 404 lost as a result of playing a talent action card 601. Other leader attributes 705 can include an effect on other game pieces (e.g., for every three value pieces 404 gained by the game piece represented by the card during gameplay, add a value piece to two other game pieces on the board), the ability to have more chips and/or talent action cards for a particular round by the player, etc.

As illustrated in FIG. 7, the talent portfolio simulation game can include event cards 710 that are representative of events that occur in talent management that are not controllable by the organization or its leaders. Event cards 710 are played between gameplay rounds, and can represent the occurrence of events such as events out of an organization's control. The event cards 710 can include an identifier of the event 711, a description of the event 712, and an event gameplay action 713 to be taken by one or more players as a result of the event. In the example illustrated in FIG. 7, the action 713 allows each player to select a game piece 400 from a rival player to replace one of their own. As stated by card 710, in this example, the selected game piece 400 to "steal" must have less than four value pieces 404 attached. Also, in defense, the rival player can opt to pay three chips 506 to retain the selected game piece 400 (e.g., representing a retention bonus). In addition, the gameplay action 713 can add additional conditions, such as restricting the hiring away of other players' leaders to those of a particular position within the organization, or that the selected leader must then (if won) replace the leader of the same position in the player's own organization. Examples of other gameplay actions 713 on event cards 710 can include rotating game pieces 400 between different players (e.g., "every player give your "Director A" game piece to the player on your right"), adding or subtracting value pieces 404 from one or more game pieces 400 from each player's board 100, adding or subtracting chips from each player's total for the next round, etc. In embodiments, the event cards 710 can be drawn in between rounds by one of the players. In other embodiments, the event cards 710 can be played by a designated moderator or game master. In these embodiments, the moderator can draw event cards 710 at random or, alternatively, can be allowed to view the cards prior to a selection.

The following is an illustrative example of talent portfolio simulation gameplay, according to the systems and methods of the inventive subject matter.

At the start of the game, each player receives a game board 100, default starting game pieces 400 (e.g., the game pieces 400 that are placed on the board 100 at the start of the game for each player), the default starting value pieces 404 to place on the default starting game pieces 400 according to the game's start conditions, a plurality of talent action cards 501 and a plurality of chips 506.

Figure 8:
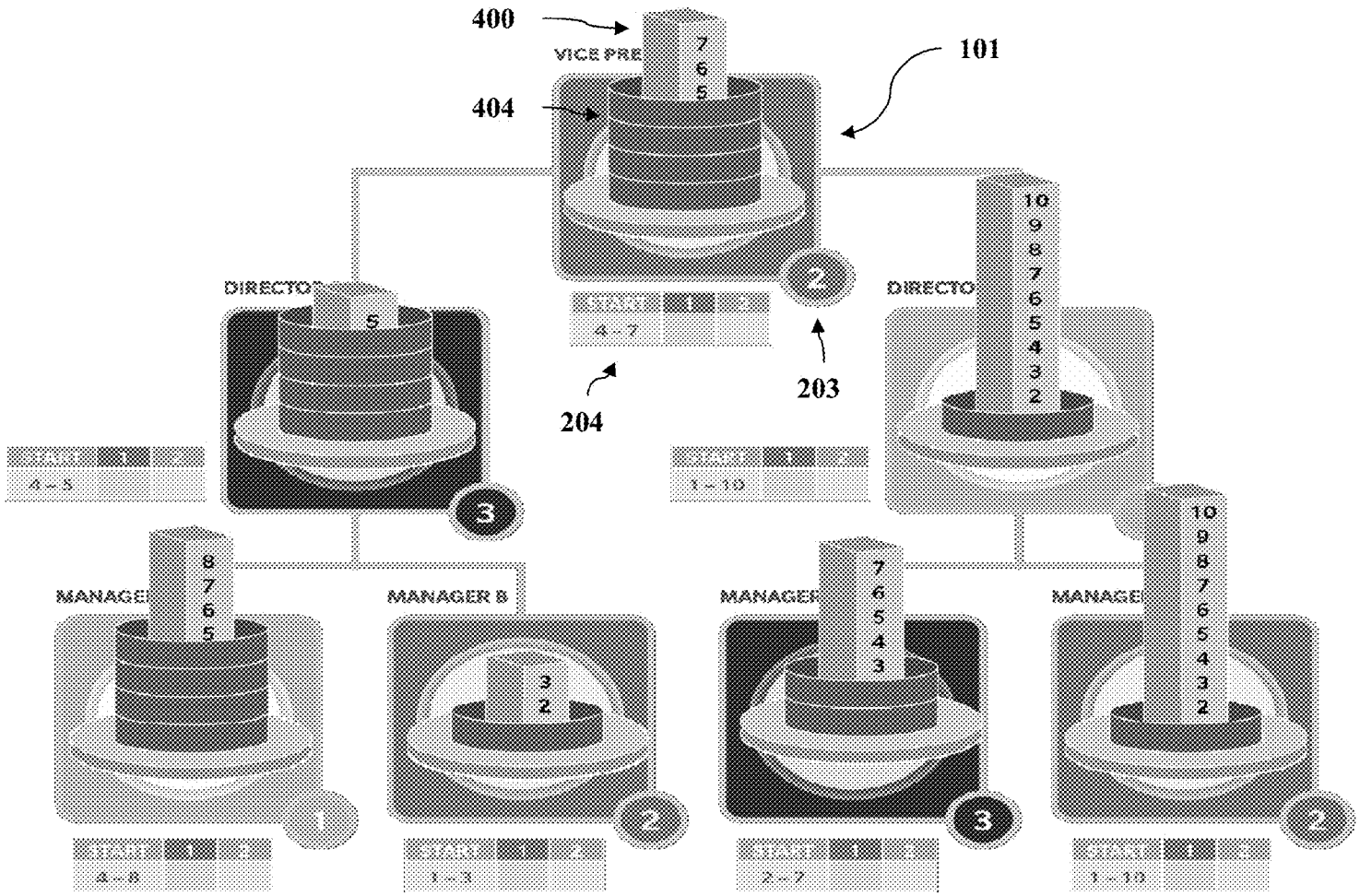
FIG. 8 provides an example of the game board having game pieces and value pieces placed according to the game's start conditions in embodiments of the inventive subject matter.

FIG. 8 provides an example of the game board 100 of FIG. 1 having game pieces 400 and attached value pieces 404 arranged at the start of the game, according to the start conditions. As discussed above, the game board's starting condition can be indicated by the scoring box 204 of each game space 101. Thus, in the example in FIG. 8, each game space 101 is shown as having a number of value pieces 404 attached to a game piece 400 of a particular potential, as indicated by the corresponding scoring box 204. For example, for the "Vice President" game space 101, the game piece 400 has a potential of "7" (as indicated by the indicia of the game piece), and has four value pieces 404 attached, as indicated by start box 204 having a start value of "4-7". In preferred embodiments, each player's game board 100 is identical and each player has identical starting conditions with regard to game pieces 400 and value pieces 404 attached thereto.

In embodiments, each player receives four talent action cards 501. The amount of chips received by each player can such that a player cannot play all four talent action cards 501 in the same round. For example, a player can receive nine chips for a round. In embodiments, the players can hold a maximum of nine chips per round. In other embodiments, leftover chips from a round can be carried over to subsequent rounds such that a player can have more than nine chips in the round.

Also present at the start of the game is a pool of talent action cards 501, a pool of game pieces 400, a pool of leader cards 701 corresponding to the game pieces 400 in the pool of game pieces, a pool of value pieces 404, die 505*a* (or spinner 505*b*), and a pool of event cards 710. If a moderator is involved, then the moderator receives the pool of event cards 710.

In the description of the inventive subject matter herein, the term "player" is used to describe an individual participant in the game having a game board. It is understood, however, that the gameplay can involve teams of players for each game board collectively working together to try and win.

At the start of the game, the starting conditions (e.g., the total realized value and total potential value) for each player can be calculated and noted on the organization's score box. The total realized value for an organization (i.e., each player's board 100) is the score according to the number of realized value represented by the value pieces 404. The total potential value, in turn, is the score according to the total amount of potential of the leaders in the organization (i.e., the indicia of all of the game pieces 400).

If all of the roles within the organization were of equal importance, then the calculated state of the organization would be "17-50" because, across all of the game pieces 400 on the board 100, there are a total of 17 value pieces 404 and the sum of the potential of all of the game pieces 400 is 50. However, not all roles in the organization are equal. As discussed above with regard to game spaces 101 in FIG. 2, some roles are more critical than others. Thus, for each game space 101, the scoring for the particular space for both the realized value and potential value is multiplied by the multiplier 203. Thus, in the example of FIG. 8, the scoring for the board 100 at the start of the game, taking account the multipliers 203 for all game spaces 101, is "35-94".

In a round of gameplay, a player can select one or more of the talent action cards 600 they currently hold to play towards one or more of their game pieces 400. In embodiments, only one talent action card 600 can be played for any one game piece 400. In alternative embodiments, more than one talent action card 600 can be played on a single game piece 400. In a variation of these embodiments, a particular talent action card 600 cannot be played for a single game piece 400 more than once in a round. In embodiments, these restrictions on the ability to play talent action cards 600 can be included on the cards 600 themselves.

If the player decides to play a talent action card to a game piece 400, the player pays the cost 503 of the gameplay action 502 indicated on the talent action card. The player then rolls the die 505*a* or spins the spinner 505*b* to determine the outcome 504 of the game action 502.

For example, a player selects a coaching card such as card 601*a*, where the action 602*a* is to "coach one team member to improve their performance." The player pays three chips per the cost 603*a* and decides to apply the card to "Director A" on game board 100. To determine the outcome 604*a* of playing card, the player rolls the die 505*a* and rolls an "M". Thus, the outcome is that the player adds one value piece 404 to the game piece 400 on the board for the "current" outcome for a "medium" roll.

In another example, the player draws an exchange card, such as card 601*b*. The action 602*b* enables the player to exchange a game piece 400, including any value pieces 404 attached thereto, currently on one of their game spaces for a game piece 400 from the pool. To do so, the player selects a leader card 701 from the pool, and places the corresponding game piece 400 having the potential indicated by the leader card 701 onto the vacated game space, as well as attaching value pieces 404 to the game piece 400 as indicated by the leader card 701. As in real life, replacing talent can be a risky proposition because the organization never truly knows exactly what they are going to get. As such, the leader represented by the game piece 400 indicated by selected leader card 701 can have more or less realized value and more or less realized potential than the leader (i.e. game piece 400) that they are replacing.

Each round in the game can continue until all players have exhausted their supply of chips 506 (i.e., no one has sufficient chips 506 to play any additional talent action cards 600) and/or until all players have made all the moves they want to make for the round (e.g., a player may have sufficient chips left for additional talent action cards, but elects to stop playing for the round). In embodiments, the rounds can be timed and as such, the exhaustion of the round time indicates the end of the round regardless of whether or not all players have finished the gameplay actions of the round.

At the end of a round, the organization score (i.e., total score for a game board) for the player can then be recalculated. Assuming that the example of playing talent card 601*a* above is the only card played in the round, the score for the organization (i.e. game board 100) as a whole can be recalculated based on the change to the "Director A" position. Since the "Director A" game space 101 includes a multiplier of "3", the realized value for this game space is increased by three with the addition of a single value piece 404. Thus, at the end of the first round, the organizational score for this player's board 100 is updated and is "38-94".

In between rounds, an event card 710 is drawn from the pool and played. In games involving a moderator or gamemaster, the event card 710 is drawn and played by the moderator as described above, and the gameplay action 713 is carried out by the players affected or to whom the gameplay action 713 is relevant. In embodiments, only one event card 710 is played in between each round. In other embodiments, more than one event card 710 can be played.

In embodiments, event cards 710 can be played during a round. In these embodiments, the playing of an event card 710 is preferably performed by a moderator. The playing of an event card 710 during a round can affect gameplay by limiting the ability of a player to react. For example, players that had spent most or all of their chips 506 prior to the playing of an event card 710 will be at a higher risk of adverse effects of the event card 710 because they will be less able to allocate chips 506 to offset the effects.

After the event card 710 has been played and gameplay action 713 is carried out by each player, the players can be given a new set of talent action cards 601 and a new set of chips 506 from the pool in preparation for the next round. As discussed herein, the amount of talent action cards 601 and chips 506 awarded to each can depend on the gameplay rules for the game limiting the amount of cards and chips each player can hold. In embodiments, the players can be required to discard any remaining talent action cards 601 and receive a whole new set of cards. In other embodiments, new cards can be given to a player only to replenish those that were spent. In embodiments, the player can be given the option of replacing one or more of cards they currently hold with new cards up to the maximum amount of cards 601 that the player can hold.

In embodiments, each player receives an identical set of talent action cards 601 at the start of the game and prior to starting each round after the first round, such that the actions available to each player is identical.

At the beginning of the next round, the "future" gameplay outcomes 604 from talent action cards 600 played in the previous round (and that remain applicable given the effects of the event card 710 and/or other talent action cards 601 played in the previous round) are carried out. In the example above whereby talent action card 601*a* was played, the "future" outcome 604*a* indicates a "+0" for a medium roll. Thus, no value pieces 404 are added to the corresponding game piece 400. If, instead of a "medium" roll, the roll result had been a "high" roll, then the player would add a value piece 404 to the game piece 400 at the start of the new round based on the "future" outcome 604*a* for a "high" roll.

After updating the game pieces 400 on a board 100, the gameplay of the next round mirrors that of the first round illustrated above. Each subsequent post-round gameplay and round gameplay similarly follows the gameplay described for the number of rounds designated for the game.

At the end of the final round, the current scoring of the organization for each player's board 100 is tallied and used as a basis to determine the winner of the game. In an organization, a member's realized value/talent and future talent potential both have value, and both factor into the value that the member represents for their organization. As such, the winner is determined based on both the total amount of value pieces 404 across all game pieces 400 on each player's board as well as the total potential amount across all game pieces 400 on each player's board. In embodiments, the tally can be a simple sum of the total of value pieces 404 with the total amount of potential for all game pieces 400. In other embodiments, the final score can be the sum times a multiplier.

In embodiments, one or more of the value pieces sum and the potential sum can be weighted in the calculation of the final score such that emphasis is placed on the realized short-term potential of the leaders (e.g., having more overall value pieces 404) or on the long-term potential of the leaders (e.g. the total potential amount across the game pieces).

In embodiments, the final score for a player can also incorporate the amount of unrealized potential. For example, the unrealized potential indicated by the amount of potential across all game pieces 400 that does not have a value piece 400 can be used as a tie-breaker, whereby for two players with boards 100 having an equal final score, the board having the most aggregated unrealized potential can be declared the winner. This is reflective of the management of the talent in an organization where the realized talent is at a competitive level, while also accounting for the future potential growth that enables the organization to increase its ability into the future.

In embodiments, the game can include additional conditions that must be met to determine a winner. For example, in addition to having the highest score, the winner cannot have a lower value piece score for their game board than at the start of the game. That is, independent of the potential of the game pieces 400 on the board 100, the total number of value pieces 404 collectively across the game pieces 400 on the board 100 at the end of the game cannot be lower than they were at the start of the game.

The game board 100 of FIG. 1 is shown as a single-piece board containing all of the game spaces and the hierarchy shown therein. However, it is contemplated that the game board 100 can comprise a plurality of separate pieces that can be assembled to make up the game board, allowing for the addition or subtraction of game spaces from a game board 100 used in the game and for the modification of the organizational structure represented by the game board. In embodiments, the game board pieces can include pieces including the game spaces 101 and one or more connecting lines that can line up with connecting lines of other game board pieces. In embodiments, the game board pieces can simply be lined up with other game board pieces to make up the board according to the connecting lines, such that the connecting lines line up.

Figure 9:
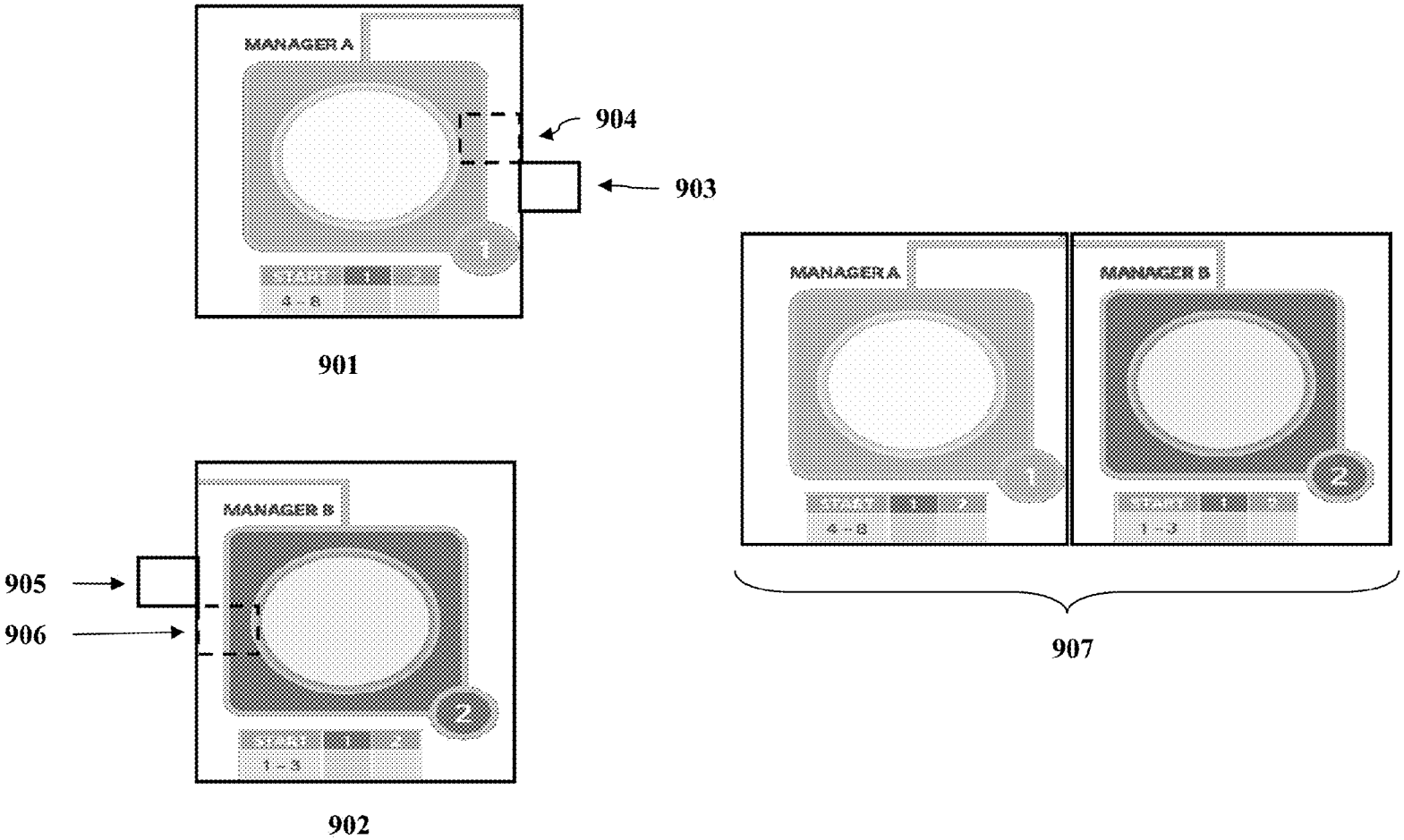
FIG. 9 provides an example of individual game board pieces separately and interlocked together to form part of a game board.

In embodiments, the game board pieces can be configured to physically interlock such that the interlocked board pieces are combined to make a unitary game board 100 that will remain together unless the interlocking mechanism is disengaged. FIG. 9 provides an illustrative example of board pieces 901 and 902 having tabs 903 and 905 (shown by the dotted lines), respectively. In connecting the board piece 901 to board piece 902, the tab 903 of board piece 901 can slide into corresponding space 906 of board piece 902. Likewise, the tab 905 of board piece 902 can slide into corresponding space 904 of board piece 901. In the example of FIG. 9, spaces 904 and 906 are shown via dotted line as being spaces or cavities within the board pieces that do not extend through the top surface of the board pieces. Thus, from the top view of these board pieces, the spaces 904,906 are not seen. However, it is contemplated that other interlocking mechanisms that allow for the interlocking of two or more board pieces as part of a game board are suitable. Likewise, in the example of FIG. 9, the board pieces 901 and 902 are only shown as having a tab and space on a particular side for the purposes of simplicity in illustrating the example. It is contemplated that the interlocking structure can be on more than one side allowing for the interlocking in all sides of the board piece, and the tab-space arrangement can be repeated along the sides of a board piece such that a board piece can interlock with another board piece without requiring that the pieces be lined up perfectly evenly. FIG. 9 also shows the board pieces 901, 902 connected together collectively as 907.

As illustrated in FIGS. 3-4, the vertical member 303 of a game piece 300 (corresponding to game pieces 400 of FIG. 4) can be a single piece. In embodiments, however, the vertical member 303 of a game piece 300 can be formed from a plurality of interlocking member pieces, such as corresponding to a single unit of indicia 303. Thus, the length of the vertical member 303 can be changed as desired. In embodiment, each member piece can have a cavity on the bottom configured to receive a corresponding interlocking member of a member piece immediately below it, and an interlocking member on the top configured to fit in the cavity of a member piece placed on top of it. In embodiments, the cavities and interlocking members of a member piece can be configured according to the indicia of the member piece such that only the member pieces having indicia immediately above and below the indicia of the member piece can be attached below or on top of the member piece. In embodiments, all game pieces 300 of the talent portfolio simulation game can have a vertical member 303 of a minimum length (e.g., of a length of "1" or "2") permanently attached to base 301.

In these embodiments, the interlocking member pieces can be used during gameplay to modify the length of the vertical member 303 (and thus, the capacity of the game piece 300 to hold value pieces) according to gameplay events. For example, a talent action card may include an outcome that involves adding or removing interlocking members from vertical member 303. In another example, the leader card corresponding to the game piece 300 can indicate that the leader's potential can vary depending on a position or hierarchy level with an organization. As such, when a game piece 300 is added to the game via a leader card or moved from one position in the organization to another (i.e. from one game space 101 to another), the length of the vertical member 303 can be dictated by the position or hierarchy level that the game piece 300 will be occupying. This can be used to reflect that a member of an organization may be better suited for a particular position, and their potential in such a position can thus be greater than in a position to which the member is not as well suited.

In embodiments, the vertical member 303 can be of a shape that mirrors the interior diameter of ring-shaped value pieces 404 such that the value pieces 404 fit snugly around the vertical member without sliding. Thus, for value pieces comprising circular rings, the vertical member 303 can have a cylindrical shape.

In embodiments, the vertical member 303 can have a uniform width such as the examples illustrated in FIGS. 3-4, such that all identical value piece 404 fit equally and in any order. In alternative embodiments, the vertical member 303 can have a non-uniform width such that, for each 'level' represented by the indicia, only a value piece of a certain type can fit. For example, the cross-sectional area of the vertical member 303 can have a gradual change from the base end to the top end such that the vertical member 303 has a pyramidal or conical shape. The value pieces 404 can correspondingly be configured to fit on the vertical member 303 such that they correspond to a particular indicia "level". Thus, for a game piece 300 with a potential of "10" (such as the game piece illustrated in FIG. 3), a value piece 404 may be large enough to fit on a level of "7" or higher, but will not be large enough to fit around any part of the vertical member 303 below the "7" indicia. The value pieces 404 can then represent realized value or potential that may be only obtained after realizing some "core" values, which cannot be used on a game piece 300 until the previous levels of potential have been realized (and the corresponding, fitting value pieces 404 added to the game piece).

In embodiments, a game piece 300 can have more than one vertical member 303, which can represent the potential of various aspects or characteristics of an organization's member. For example, in a game piece 300 with three vertical members, the vertical members can represent a person's capability, level of engagement, and a fit with a culture or institutional mindset. In these embodiments, the talent action cards can include gameplay actions and outcomes directed to one or more of the vertical members of a game piece. Additionally, the value pieces 404 can include multi-value pieces that simultaneously fit on more than one vertical member 300, representing a realized value or potential is cross-correlated among the characteristics of an individual. In embodiments where value pieces 404 comprise rings, the multi-value pieces fitting more than one vertical member can include linked rings such that they fit over more the more than one vertical member simultaneously. Gameplay actions can incorporate this by allowing for the adding of value pieces on top of the multi-value pieces on all of the vertical members to which the multi-value pieces are attached even if, for example, for one of the vertical members the multi-value ring does not sit on any value pieces of its own (because it is supported by value pieces on one or more of the other vertical members to which it is attached). In gameplay, this can function as a multiplier for the purposes of scoring or other enhancement.

In embodiments, the talent management portfolio game can include one or more computer-executable applications that, when executed by a computer, can enhance the gameplay. The applications ("apps") can be stored on a non-transitory computer readable medium and executed by one or more processors to carry out the app functions. Examples of computing devices suitable for execution of the apps can include desktop, laptop or mobile computing devices, smartphones, tablets, etc. The computing devices can have input interfaces to receive input from users (e.g., keyboard, mouse, microphone, touch-screen input, stylus, etc.), output interfaces to provide output to users (e.g., display screen, audio output such as speakers, etc.), network interfaces allowing for data interchange with other computing devices (e.g., long-range or short-range data communications, wireless and/or wired data connections, via Internet, cellular, etc.).

In one example, the game apps can include a scoring app programmed to perform score-keeping functions associated with the game. The game app can be programmed to receive an input from a user regarding the game pieces and value pieces being played on a game board and perform score-keeping accordingly. The game app can also be programmed to calculate an end-game score based on end-game scoring rules to determine a winner.

In a variation of this example, the input can be provided via machine-readable indicia on one or more of the game board, game pieces, value pieces, talent action cards, leader cards, event cards, and random outcome generator. Examples of machine-readable indicia can include barcodes, QR codes, and other machine-readable indicia. In these examples, the information on the machine-readable indicia can be provided to the scoring app via a dedicated scanner or a camera on (or communicatively coupled with) the computing device that can provide scanning capabilities. The information associated with each of the game components can be correlated by the scoring app for the purposes of determining scoring and other gameplay functions and outcomes. In embodiments, the data exchange between the game components and a computing device executing game-related applications can be implemented via RFID technology.

In another example, the random outcome generator can be implemented via an app in addition to, or instead of, the die 505*a* or spinner 505*b*, such as via a random number generator app, whereby the app provides a result of "H", "M" or "L" (or "High", "Medium" and "Low" as determined by the capabilities of output interface of the computing device) to an input command of "roll" or "spin."

In embodiments of the inventive subject matter, computer-executable applications associated with the talent portfolio simulation game can include reporting functions such as tracking game usage and results, allow users to provide feedback, track player development over time (e.g. score progressions indicative of becoming better at talent management), compliance with licensing arrangements, etc. These reporting functions can be integrated into other apps (e.g. the scoring app) or be independent of other game-related apps. The reporting functions can be performed via the executing computing device's networking/data exchange interfaces, and data associated with the reporting functions can be transmitted via data exchange networks to databases, servers, and other computing devices of the organization or run by a third party for analysis, report generation, progress mapping, and other functions. In embodiments, these reporting functions can be implemented via an online tool accessible via a web browser, whereby the information can be entered manually by users or provided by a computing device running game-associated applications and accessed by appropriate organization or third-party personnel.

It is contemplated that, in addition to the description of the talent portfolio simulation game provided above, the inventive subject matter can include a computer game version executable on one or more computing devices, such as those described above. In these embodiments, the talent portfolio simulation game can comprise computer-executable instructions stored on one or more non-transitory computer-readable media such that when the instructions are executed by one or more processors, the processor carries out functions and processes associated with the inventive subject matter. In these embodiments, one or more of the components can be represented via an output interface of the computing devices. For example, the game board, game pieces, value pieces, and other game components can be depicted audio-visually and game play actions and outcomes depicted audio-visually via video and audio output interfaces. Likewise, players can provide gameplay input via a computing device's input devices corresponding to gameplay situations requiring player interaction.

In embodiments, the players can play the game via a plurality of computing devices communicatively coupled via a data exchange network, such that each player is able to provide gameplay input and receive output from their own individual computing device. In other embodiments, the game can be executed entirely on a single computing device whereby the computing device is programmed to provide an indication of the intended player recipient of any output and/or prompting the appropriate player for necessary input, such that the computing device input/output interfaces can be passed around or otherwise shared by the players for gameplay on a single computing device.

In computer game embodiments of the inventive subject matter, it is further contemplated that the game can include reporting functions such as those described associated with usage, performance, feedback, licensing, etc.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A talent management game comprising:

a plurality of game pieces corresponding to members of an organization, each of the game pieces comprising:

a base; and an upright member coupled to the base, wherein the upright member includes sequential numerical indicia along a vertical side representative of the potential of the individual represented by the game piece, the sequential numerical indicia ascending from the lower end to the upper end of the upright member;

a plurality of value pieces attachable to the upright member of a game piece, wherein the number of value pieces attachable to a particular game piece correspond to the highest number value of the sequential numerical indicia of the particular game piece, wherein the length of the upright member of the game pieces will be of varying lengths to accommodate varying numbers of identical value pieces has been added;

at least one game board, each of the at least one game board comprising:

a plurality of game spaces corresponding to positions within the organization arranged according to a hierarchical tree structure, each of the plurality of game spaces comprising:

a game piece space corresponding to the size and shape of the base of at least one game piece from the plurality of game pieces, such that the at least one game piece is placed on the game piece space;

a numerical multiplier indicator;

an indication of the title of the position represented by the game space; and a set of talent action cards;

a set of leader cards corresponding to the plurality of game pieces;

a plurality of game chips;

a random outcome generator configured to generate an outcome of "H", "M" or "L" in response to player interaction.

2. The game of claim 1, wherein each of the plurality of game spaces further comprises an indication of:

a game piece to be placed in the game piece space at the start of the game, wherein the indication of the game piece to be placed comprises an indicia corresponding to the highest number of the sequential numerical indicia of the game piece; and a number of value pieces to be attached to the game piece at the start of the game.

3. The game of claim 1, wherein the random outcome generator comprises a die, and wherein each of the faces of the die include an indicia of "H", "M" or "L", whereby each of the "H", "M" and "L" indicia are included on the die at least once.

4. The game of claim 1, wherein the random outcome generator comprises a spinner.

5. The game of claim 1, wherein each talent action card from the set comprises a gameplay action, a gameplay action cost in chips, and a gameplay outcome.

6. The game of claim 1, wherein each leader card comprises an identifier of the corresponding game piece, wherein the identifier comprises at least one of a length of a vertical member, a game piece type, and a game piece name.

7. The game of claim 6, wherein each leader card further comprises at least one of:

a gameplay modifier associated with the corresponding game piece; and an indicator of a default number of value pieces associated with the corresponding game piece.

8. The game of claim 1, wherein the vertical member comprises a plurality of separable, interlocking member pieces, each member piece corresponding to an individual indicium according to the sequential numerical indicia scheme.

9. The game of claim 1, wherein each of the plurality of game spaces further comprises a separable, interlocking game board piece such that the game board is constructed by connecting at least two of the plurality of game board pieces.

10. The game of claim 1, further comprising a set of event cards, wherein each event card from the set comprises a gameplay event action applicable to all players participating in the game.

* * * * *